US005166471A

United States Patent [19]

Maselli et al.

[11] Patent Number: 5,166,471

[45] Date of Patent: Nov. 24, 1992

[54] WARHEAD INCORPORATING HIGH-DENSITY PARTICLES

[75] Inventors: Michael Maselli, Bergenfield, N.J.; Timothy D. Howard, Georgetown; John C. Hebeisen, Andover, both of Mass.

[73] Assignee: Industrial Materials Technology, Inc., Andover, Mass.

[21] Appl. No.: 700,234

[22] Filed: May 14, 1991

Related U.S. Application Data

[63] Continuation-in-part of Ser. No. 697,120, May 8, 1991.

[51] Int. Cl.[5] ..... F42B 12/32

[52] U.S. Cl. ..... 102/496; 102/491

[58] Field of Search ..... 102/491, 492, 493, 494, 102/495, 496, 497, 506

[56] References Cited

U.S. PATENT DOCUMENTS

| | | | |
|---|---|---|---|
| 3,255,659 | 6/1966 | Venghiattis | 86/20.14 |
| 3,498,224 | 3/1970 | Cordle et al. | 102/496 |
| 4,032,335 | 6/1977 | Zapf et al. | 102/496 |
| 4,351,240 | 9/1982 | McCubbin et al. | 102/493 |
| 4,365,560 | 12/1982 | Frostig | 102/493 |
| 4,381,692 | 5/1983 | Weintraub | 102/493 |
| 4,383,468 | 5/1983 | Sie et al. | 86/20.14 |
| 4,592,283 | 6/1986 | Hellner et al. | 102/496 |
| 4,644,867 | 2/1987 | Hellner et al. | 102/496 |
| 4,870,884 | 10/1989 | Schubert et al. | 86/20.12 |

*Primary Examiner*—David H. Brown
*Attorney, Agent, or Firm*—Lahive & Cockfield

[57] ABSTRACT

Improved missile warhead body has three sections forming a tubular body closed by a cap section at one end thereof and having a center section comprising high density material inclusions of a selected size and weight which separate from the warhead when detonated and form shrapnel on the order of the size and weight of the high density material inclusions.

3 Claims, 2 Drawing Sheets

WARHEAD INCORPORATING HIGH-DENSITY PARTICLES

GOVERNMENT INTEREST

The invention described herein may be made or used by or for the U.S. Government for Governmental purposes without the payment of any royalty thereon.

BACKGROUND OF THE INVENTION

This application is a continuation-in-part of co-pending application Ser. No. 07/697,120, filed May 8, 1991, entitled WARHEAD INCORPORATING HIGH DENSITY PARTICLES.

The present invention relates to forming of warheads by isostatic compaction, and more particularly to forming a warhead with high-density particulate inclusions.

Cold isostatic pressing is one process of choice for forming components from particulate materials. In cold isostatic pressing, a powder charge is loaded into an elastomeric mold (called a "bag"). The bag is sealed after filling, positioned within the containment vessel, and exposed to a pressurized fluid environment.

The bag may be part of the pressure vessel (dry bag process) or may be a separate, independent unit placed within the pressure vessel (wet bag process). In either case, a mandrel may be included within the bag to aid in forming details on the resulting pressed material.

In operation, the fluid is pressurized and in turn applies a hydrostatic pressure to the bag. The bag thus acts as a hermetically sealed pressure transfer membrane between the fluid environment and the loaded material charge. If a mandrel is included inside the bag, then the pressure compacts the powder against the mandrel. Upon completion of the pressing process, the vessel and bag are opened and the pressed part (called a "preform") is separated from the mandrel. The preform is then thermally treated, sintered, to increase strength through diffusion bonding, and may also be hot isostatically pressed to final density.

However, removal of the mandrel from the preform may present special difficulty when parts of unusual, complex, or tapered interior are formed by such processing. For this reason, complex patterns are usually machined rather than pressed onto the interior of those parts requiring such patterns.

In copending application Ser. No. 07/669,055, filed Mar. 14, 1991, entitled COMPACTION METHOD AND APPARATUS USING PRE-FABRICATED PATTERN FORM, incorporated herein by reference, a method and apparatus are provided in which a fragmentation pattern is formed on the inner diameter of a missile warhead body preform. The warhead body preform is then processed to final form. The finished warhead body is loaded with an explosive charge on a missile body. An aerodynamic nosecone caps the end of the warhead.

When the missile is at target, the explosive is detonated and the warhead body is exploded in a fragmentation pattern formed of well-defined shrapnel. Formation of such shrapnel is particularly useful when the weapon is detonated adjacent to the target.

Highly dense parts of complex design can be easily manufactured by means of the above cold isostatic process. Particulate materials used may include tungsten and titanium, among many other materials. The above warhead body preforms are typically pressed from titanium powder. Tungsten is denser than titanium and therefore a tungsten warhead would produce much more lethal shrapnel than a titanium warhead, but a tungsten warhead body preform would be harder to machine, heavier, and less sturdy than one formed from titanium. Therefore titanium is a material of choice for manufacture of such warheads.

It is therefore an object of the present invention to provide a warhead formed by cold isostatic processing and having improved fragmentation characteristics.

It is another object of the present invention to provide a medium weight warhead which can deliver heavy-weight shrapnel.

SUMMARY OF THE INVENTION

The present invention provides an improved missile warhead having increased lethality. In the disclosed method, high-density particulate material is incorporated into the warhead body during compaction. The high-density inclusions are preferably compatible with the material of the warhead body. The warhead body is preferably compacted from titanium alloy powder. For a titanium warhead body, the inclusions may be of various shapes, of tungsten, depleted uranium, tantalum, hafnium, and various alloys thereof, including tungsten carbide, tungsten titanium, and the like, for example.

A missile having a warhead incorporating the invention preferably has a device to detonate the warhead at the point of closest approach to the target, whereby the included high-density particles act as armor-piercing projectiles on the order of the size and weight of the high-density inclusions. In a missile weapon having such improvement, a target can be severely damaged without a direct hit, thus increasing the lethality of such weapon.

The particles are preferably incorporated into a warhead body preform in an ordered array. In a particular embodiment, pure tungsten particles are included in the ID of a Stinger missile warhead body in a matrix of $5 \times 5$ particles per square inch in an ordered cylindrical array.

Generally, the particle spacing in the ordered array ranges from about $\frac{1}{2}$ to $1\frac{1}{2}$ times the average particle diameter, wherein about 100–600 particles are applied in this manner. The shapes of these particulate inclusions may be as cylinders, rectangular or triangular parallelepipeds, irregular powder granules, round powder "BB"s, and rods (the latter preferably having a height to diameter aspect ratio ranging from 5–50 to 1), for example. In one embodiment, right circular cylindrical particles, each having a 0.065" radius and 0.130" height, are arrayed in a manner set forth below.

These high-density particles are incorporated into the ID of the finished warhead body preform by any of several disclosed methods. In one embodiment of the invention, a grid pattern of glue is applied to a mandrel and then the particles are applied thereto, e.g., by dipping or rolling the glued-patterned mandrel in a bath of irregular powder granules or round powder "BB"s. This assembly is loaded inside of a conventional processing bag along with powder material, and then the sealed bag is subjected to cold isostatic pressing. Thereafter, the mandrel is removed, yielding an improved warhead body preform having high-density particles embedded therein.

In another embodiment, a perforated sheet (such as of plastic or metal) is formed into a cylinder and slid over the mandrel as a glue mask. The glue is then applied to the mandrel through the mask perforations in a grid of glue spots which expresses the desired ordered array of particles, and then the glue mask is removed and a respective particle is individually applied on-end to a respective glue spot to form the desired ordered array of high-density particles. This assembly is loaded with powder material into an elastomeric bag for the above processing.

In still another embodiment, rod shaped particles are glued to the mandrel along their OD longitudinal axis, and then processed as above. In yet another embodiment, the particles are blended into a portion of the powder from which the warhead body is compacted, which avoids the gluing process entirely, and then the powder is compacted against a mandrel in a conventional manner.

BRIEF DESCRIPTION OF THE DRAWINGS

These and other features and advantages of the present invention will be more fully understood by reference to the following detailed description in conjunction with the attached drawing in which like reference numerals refer to like elements and in which.

DETAILED DESCRIPTION OF PREFERRED EMBODIMENTS

Figure 1:
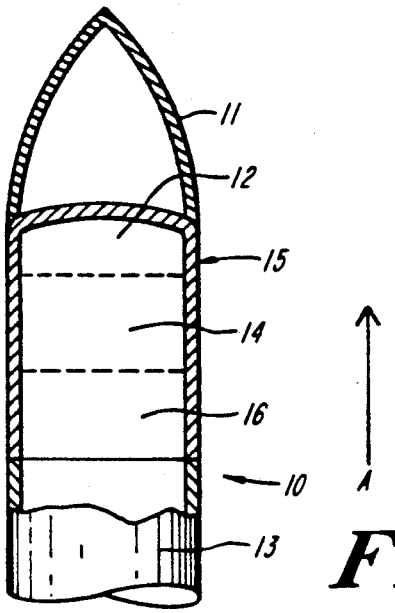
FIG. 1 is a partial side view of a missile incorporating the invention.

A typical missile which may incorporate the invention is partially shown in the cross-section of FIG. 1, having a nosecone 11 attached to a warhead body 10, which in turn is mounted on a missile body 13. The missile body includes guidance and propulsion systems. An explosive charge (not shown) is loaded within the interior 15 of the warhead body to form an explosive warhead. Preferably a system is included in the missile to control warhead detonation as the missile comes adjacent to the target.

A conventional Stinger missile warhead body is formed in stages: titanium alloy powder (such as Ti 6-6-2 or Ti 6-4, for example) is cold isostatically formed into a warhead body preform which is then sintered, hot isostatically pressed, and machined to final dimensions to obtain the warhead body 10.

Warhead body 10 of the invention has three integral and essentially cylindrical sections: a cap section 12, a center section 14, and a mounting section 16, the latter for mounting of the warhead body to the missile body. When the explosive charge is detonated, the cap section is blown outward generally along the missile projectile axis A, while the center section is essentially returned to its original powder form, and quite likely is ignited into a high intensity heat source. Thus upon impact with the target, severe fire damage can be obtained.

In a preferred method of the invention, an improved Stinger warhead body is generally formed of lighter-weight compacted powder, such as titanium alloy powder, with high-density particles included within the warhead body center section 14. As a result, at detonation, high-density shrapnel is expelled outward from the missile warhead generally perpendicular to the missile projectile axis A, allowing the missile to be substantially mechanically destructive to the target when detonated either at or adjacent to the target, regardless of fire damage.

The high-density material inclusions are only in the center section 14 where they are maximally effective as shrapnel. Thus the amount required of the heavier high-density material inclusion is minimized, while being carried in a lighter weight and easier to machine compacted-powder warhead body.

Figure 2:
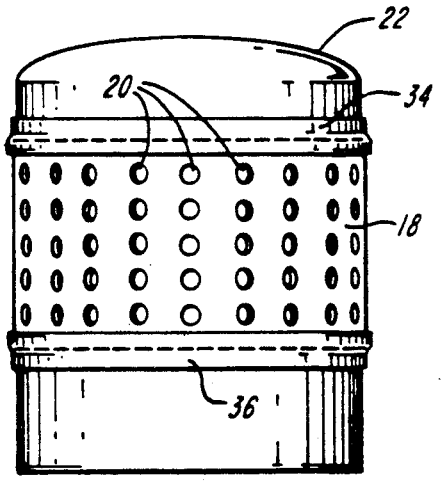
FIG. 2 is a side view of a mandrel with glue mask applied thereto, in practice of the invention.
Figure 3:
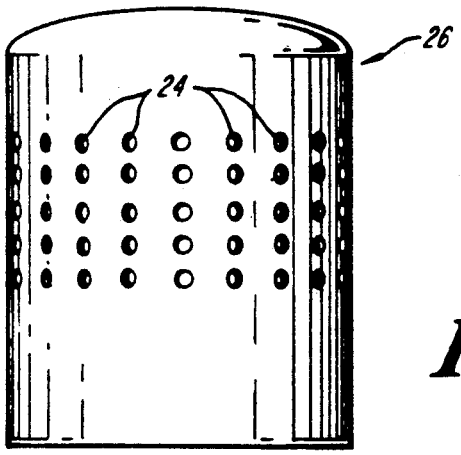
FIG. 3 is a side view of a mandrel with a glue spot array, in practice of the invention.

Referring to FIG. 2-3, it will be appreciated that a glue mask 18, which is patterned with voids 20 in an array representing the particle array desired to be formed on the ID of the warhead body preform, is mounted on a mandrel 22. (The mandrel OD is selected relative to the ID of the warhead body preform sought to be formed.) Then a glue is applied over the mask to form an array of glue spots 24 in the desired array pattern 26 on the face of the mandrel in a location associated with the center section 14 of the warhead body. Preferably the glue is slow drying, such as rubber-based type, available as GOODYEAR Pliobond Nybco spray glue, and is sprayed over the mask. The mask is then removed leaving glue spots formed in the desired array.

Figure 4:
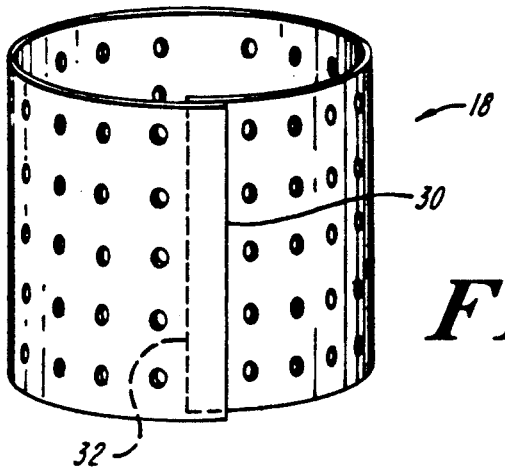
FIG. 4 is a perspective view of a glue mask, in practice of the invention.

In one particular embodiment of the invention, a glue mask 18 is formed from a perforated brass sheet, 0.030 inches thick, rolled so that two of its ends 30, 32 meet and can be spot-welded to form a cylinder, shown in FIG. 4, having an ID which will permit it to closely fit over the mandrel OD. Again, this mask is placed over the mandrel in a location associated with the center section 14 of the warhead body. The mask is now secured to the mandrel, such as by means of two wide bands of tape 34, 36. The tape also acts as a mask along the upper and lower borders of the glue mask, preventing application of glue to outlying areas of the mandrel. Now the glue is applied (e.g., sprayed) over the glue mask and then the tape and the glue mask are removed, leaving the desired array of glue-spots 24 on the mandrel.

Figure 5:
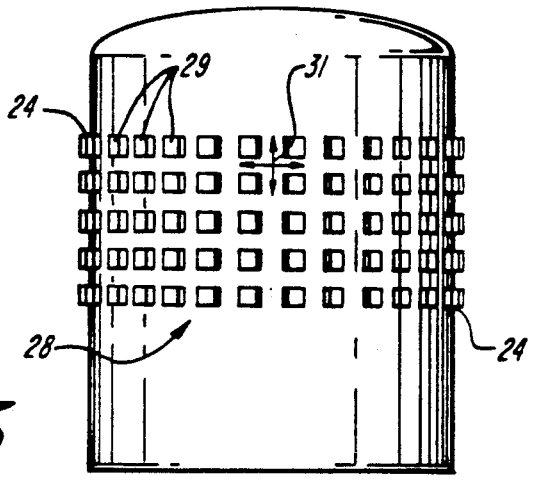
FIG. 5 is a side view of a mandrel with an array of high-density particulate material applied thereto, in practice of the invention.

As shown in FIG. 5, high-density particles 29 are applied, such as by hand or other suitable method, to glue spots 24 to form particle array 28. The particles preferably have a fairly uniform spacing 31.

Figure 6:
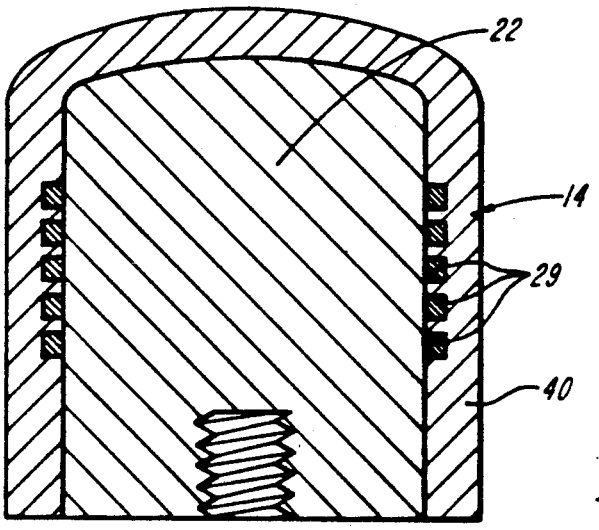
FIG. 6 is a side cross-sectional view of an improved warhead body preform formed on a mandrel, in practice of the invention.

After the particles have been applied, the mandrel with the glued-on array of particles is loaded and sealed along with a powder charge, such as titanium alloy powder, in an elastomeric processing bag and is subjected to cold isostatic pressing within an appropriate pressure chamber. By means of this processing, as seen in FIG. 6, the high-density particles 29 are compacted along with the included powder charge into an improved missile body preform 40, with particles 29 anchored in the interior wall of the preform in center section 14, although the distal end of each of the particles remains glued to mandrel 22.

Now the compacted assembly is removed from the processing bag as a unit and is heated to 75-150 degrees centigrade for 20 minutes, which expands the improved warhead body preform and softens the glue and permits separation of the glued distal ends of the particles from the mandrel. The mandrel is now removed from the improved warhead body preform, such as by means of the vise/slide-hammer arrangement disclosed in the above-mentioned copending application Ser. No. 07/669,055, filed Mar. 14, 1991.

Next, the improved warhead body preform is sintered to fuse the titanium powder up to about 97 percent density, and then the preform is hot isostatically processed to full density and machined to final dimensions.

In an alternative embodiment of the invention, a solid coat of glue is applied to the mandrel at a location consistent with the warhead body center section 14, and this glued surface is then subjected to, e.g., rolled in, a bed of particles. Such particles may include, e.g., BBs or granules having a weight of around 0.1 to 2.0 grams per particle. The process then proceeds as described above.

In another alternative embodiment, glue is applied to rods or to the mandrel, and the rods are then applied to the mandrel with their longitudinal axes aligned along the longitudinal axis of the mandrel. The rods may have various lengths perhaps from ½ to 2 inches, with a diameter of about 1/16 to ⅛ inches. The process then proceeds as described above.

In yet another alternative embodiment, the mandrel is placed in the processing bag on top of a layer of titanium powder to form cap section 12, then the bag is further loaded with a mixture of titanium and high-density particles (e.g., tungsten) to form center section 14, and then the load is topped off with titanium powder to form mounting section 16. Now cold isostatic processing produces a warhead body preform having high-density particles intimately formed in a shrapnel zone at the center section 14. The warhead body preform is now removed, hot isostatically processed to full density and machined to final dimensions.

It will be understood that the above description pertains to only several embodiments of the present invention. That is, the description is provided by way of illustration and not by way of limitation. The invention, therefore, is to be limited according to the following claims.

What is claimed is:

1. An improved missile warhead comprising a cap section, a center section, and a mounting section, these sections formed of a common powder material compacted to a uniform density, the cap section extending into the center section and the latter extending into the mounting section, the three sections forming a tubular body closed by the cap section at one end thereof, the cap section comprising means for receiving a missile nosecone, the mounting section comprising means for attachment of the warhead to a missile body, and only the center section comprising high-density material inclusions of a selected size end weight for separation from the detonated warhead to form shrapnel on the order of the size and weight of the high-density material inclusions, wherein the high-density material inclusions are integrally formed as part of the center section as an embedded array at the ID of the center section.

2. The warhead of claim 1 wherein the warhead comprises compacted titanium powder.

3. The warhead of claim 1 wherein the array is an approximate 5×5 inch ordered cylindrical array of particles.

* * * * *